US009175687B2

(12) United States Patent
Hirata

(10) Patent No.: US 9,175,687 B2
(45) Date of Patent: Nov. 3, 2015

(54) COMPRESSION APPARATUS

(71) Applicant: Kobe Steel, Ltd., Kobe-shi (JP)

(72) Inventor: Kazuya Hirata, Kako-gun (JP)

(73) Assignee: Kobe Steel, Ltd., Kobe-shi (JP)

( * ) Notice: Subject to any disclaimer, the term of this patent is extended or adjusted under 35 U.S.C. 154(b) by 473 days.

(21) Appl. No.: 13/666,267

(22) Filed: Nov. 1, 2012

(65) Prior Publication Data

US 2013/0129480 A1 May 23, 2013

(30) Foreign Application Priority Data

Nov. 17, 2011 (JP) ..... 2011-251440

(51) Int. Cl.

| | |
|---|---|
| ***F04D 29/58*** | (2006.01) |
| ***F04D 15/00*** | (2006.01) |
| ***F04D 15/02*** | (2006.01) |
| ***F04B 39/06*** | (2006.01) |
| ***F04D 27/00*** | (2006.01) |

(52) U.S. Cl.

CPC ..... *F04D 15/0022* (2013.01); *F04B 39/066* (2013.01); *F04D 15/0263* (2013.01); *F04D 27/003* (2013.01); *F04D 29/5826* (2013.01); *F05D 2260/211* (2013.01); *F05D 2260/213* (2013.01); *F05D 2270/112* (2013.01); *F05D 2270/3013* (2013.01)

(58) Field of Classification Search

CPC ..... F04D 15/0022; F04D 15/0263; F04D 15/0281; F04D 27/003; F04D 29/5826; F05D 2260/211; F05D 2260/213; F05D 2270/112; F05D 2270/3013; F05D 2270/44

USPC ..... 415/118, 151, 179, 17, 47

See application file for complete search history.

(56) References Cited

U.S. PATENT DOCUMENTS

| | | | | |
|---|---|---|---|---|
| 4,502,833 | A | 3/1985 | Hibino et al. | |
| 5,306,116 | A | 4/1994 | Gunn et al. | |
| 5,386,873 | A | 2/1995 | Harden, III et al. | |
| 6,174,137 | B1 | 1/2001 | Nakamura | |
| 6,442,942 | B1 * | 9/2002 | Kopko | 60/773 |
| 8,375,733 | B2 * | 2/2013 | Preston et al. | 62/186 |
| 2009/0217655 | A1 | 9/2009 | Yabuki | |
| 2013/0061619 | A1 * | 3/2013 | Saitou et al. | 62/89 |
| 2014/0151015 | A1 * | 6/2014 | Sun et al. | 165/253 |

FOREIGN PATENT DOCUMENTS

| | | | |
|---|---|---|---|
| CN | 1862019 | A | 11/2006 |
| CN | 101010497 | A | 8/2007 |
| CN | 100470054 | C | 3/2009 |

(Continued)

*Primary Examiner* — Ninh H Nguyen

(74) *Attorney, Agent, or Firm* — Oblon, McClelland, Maier & Neustadt, L.L.P.

(57) ABSTRACT

Provided is a compression apparatus for cooling multiple devices using a single fan with a small amount of electric power. An upper limit temperature, a first gain applied in a case in which a suction adjustment valve is opened, and a second gain applied in a case in which the suction adjustment valve is closed are set in advance for each of multiple temperature detectors provided at different locations of the compression apparatus; and, for each of the multiple temperature detectors, a difference between a detected value and the upper limit temperature is calculated, and a rotation speed of the fan is determined based on the smallest value in the differences, and the first gain or the second gain set for the temperature detector having the smallest difference.

6 Claims, 1 Drawing Sheet

(56) References Cited

FOREIGN PATENT DOCUMENTS

| | | | |
|---|---|---|---|
| JP | 58-70078 | A | 4/1983 |
| JP | 6-10885 | A | 1/1994 |
| JP | 3607042 | B2 | 10/2004 |
| JP | 3773443 | | 2/2006 |
| JP | 2006-316696 | A | 11/2006 |
| JP | 4418321 | | 12/2009 |
| JP | 4842264 | B2 | 10/2011 |

* cited by examiner

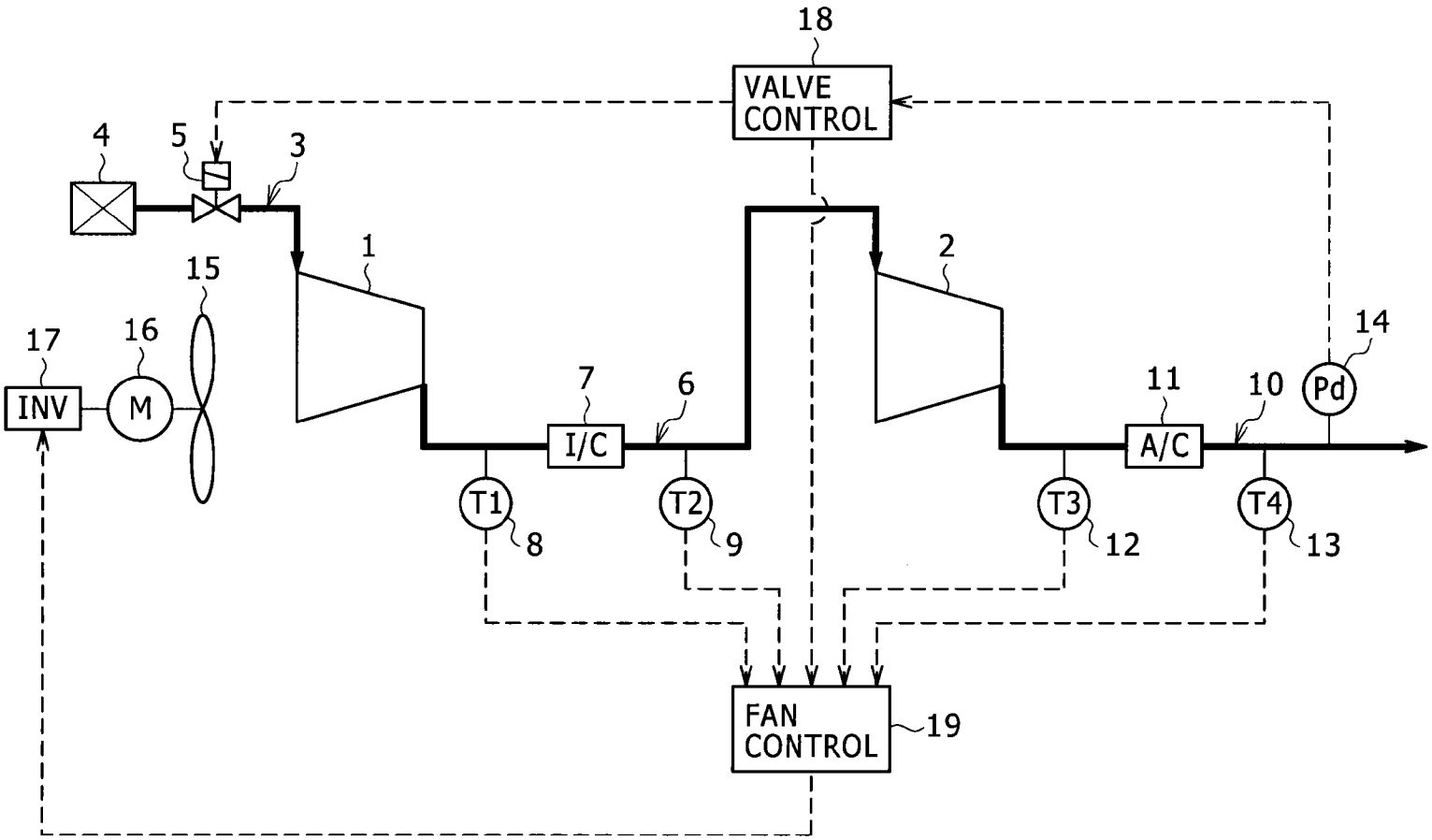
VALVE CONTROL
FAN CONTROL
I/C
A/C
INV
M
Pd
T1
T2
T3
T4
1
2
3
4
5
6
7
8
9
10
11
12
13
14
15
16
17
18
19

COMPRESSION APPARATUS

BACKGROUND OF THE INVENTION

1. Field of the Invention

The present invention relates to a compression apparatus.

2. Description of the Related Art

A compression apparatus which compresses a gas, is configured to store a compressor and incidental devices such as an aftercooler in a package (housing), and includes a fan for cooling the respective devices is widely used. In this compression apparatus, a single fan cools not only the compressor but also an intercooler and the aftercooler (refer to Japanese Patent Nos. 3773443 and 4418321).

In a compression apparatus for cooling multiple devices by using a single fan, a fan having a large capacity is often provided in order to sufficiently cool all the devices even under the worst condition. Moreover, if the fan having a large capacity is operated at the maximum capacity in order to sufficiently cool all the devices, there poses a problem that power consumption increases. Further, the operation of the fan having a large capacity increases noise.

SUMMARY OF THE INVENTION

The present invention has been made in view of the above-mentioned problems, and therefore has an object to provide a compression apparatus for cooling multiple devices using a single fan with a small amount of electric power consumed by the fan.

In order to solve the problems, the compression apparatus according to the present invention includes: a compressor, multiple temperature detectors that are provided at different locations, a cooling fan that is capable of changing a rotation speed, and fan control means that determines the rotation speed of the cooling fan based on detected values by the multiple temperature detectors; in which the fan control means sets, in advance, an upper limit temperature and a control gain to each of the multiple temperature detectors, calculates a difference between the detected value and the upper limit temperature for each of the multiple temperature detectors, and determines the rotation speed of the fan based on the smallest value in the differences and the control gain set to the temperature detector having the smallest difference.

According to this configuration, since the rotation speed of the fan is adjusted according to a portion most requiring cooling, a cooling capability of the fan is optimized and electric power consumption can be reduced to the minimum.

The compression apparatus configured as mentioned before may include a suction adjustment valve that is provided in an intake channel for supplying the compressor with a gas, a pressure detector that detects a discharge pressure of a compressed gas, and valve control means that opens/closes the suction adjustment valve according to the detected value by the pressure detector; in which the control gain may include a first gain applied in a case in which the suction adjustment valve is opened, and a second gain applied in a case in which the suction adjustment valve is closed.

According to this configuration, the cooling capability of the fan can further be optimized according to the closing/opening of the suction adjustment valve.

In the compression apparatus configured as mentioned before, each of the control gains may include a plurality of constants.

According to this configuration, for example, feedback control using complex functions such as the PID control can be carried out.

The compression apparatus configured as mentioned before may include a plurality of the compressor, in which the compressors may serially be connected with each other, and at least one of the temperature detectors may be disposed in a channel between the compressors. Further, an intercooler may be provided in the channel between the compressors, at least one of the temperature detectors may be provided on an upstream side of the intercooler, and at least one of the temperature detectors may be provided on a downstream side of the intercooler.

According to this configuration, a cooling capability of a two-stage compressor can be optimized.

In the compression apparatus configured as mentioned before, an aftercooler may be provided on a discharge side of the compressor, at least one of the temperature detectors may be provided on an upstream side of the aftercooler, and at least one of the temperature detectors may be provided on a downstream side of the aftercooler.

This configuration can further increase the cooling capability.

BRIEF DESCRIPTION OF THE DRAWINGS

In the accompanying drawing,

FIG. 1 is a schematic configuration diagram of a compression apparatus according to an embodiment of the present invention.

DESCRIPTION OF THE PREFERRED EMBODIMENTS

A description will now be given of an embodiment of the present invention referring to the drawing. FIG. 1 shows a compression apparatus according to an embodiment of the present invention. The compression apparatus according to the embodiment produces a compressed air, and includes a first compressor 1 and a second compressor 2 serially connected with each other.

A suction filter 4 and a suction adjustment valve 5 are provided in an intake channel 3 for supplying the first compressor 1 with air. An intercooler 7, a first temperature detector 8 for detecting a temperature of air discharged by the first compressor 1 in the upstream of the intercooler 7, and a second temperature detector 9 for detecting a temperature of air supplied to the second compressor 2 in the downstream of the intercooler 7 are provided in an intermediate channel 6 connecting the first compressor 1 and the second compressor 2 with each other. In a discharge channel 10 for supplying a destination requiring the compressed air with the compressed air from the second compressor 2, an aftercooler 11, a third temperature detector 12 for detecting a temperature of air discharged by the second compressor in the upstream of the aftercooler 11, a fourth temperature detector 13 for detecting a temperature of air discharged into a channel leading to the destination in the downstream of the aftercooler 11, and a discharge pressure detector 14 for detecting a pressure of air discharged in the downstream of the aftercooler 11 are provided. In other words, multiple temperature detectors (the first to fourth temperature detectors 8, 9, 12, and 13) are provided at different locations.

The compression apparatus according to this embodiment includes a fan 15 for cooling the above-mentioned components, particularly the first compressor 1, the second compressor 2, the intercooler 7, and the aftercooler 11. A rotation speed of a motor 16 for driving the fan 15 is set by an inverter 17.

Moreover, the compression apparatus according to this embodiment further includes: a valve control device 18 (valve control means) which opens/closes the suction adjustment valve 5 based on a detected value Pd of the discharge pressure detector 14; and a fan control device 19 (fan control means) to which detected values by the first to fourth temperature detectors 8, 9, 12, and 13 and an output signal of the valve control device 18 are input, and which sets a frequency of the inverter 17, namely a rotation speed of the fan 15.

An upper limit pressure PdH and a lower limit pressure PdL are set to the valve control device 18. If the detected value Pd by the discharge pressure detector 14 becomes equal to or more than the upper limit pressure PdH, the valve control device 18 closes the suction adjustment valve 5, and if the detected value Pd by the discharge pressure detector 14 becomes equal to or less than the lower limit pressure PdL, the valve control device 18 opens the suction adjustment valve 5. The fan control device 19 stores in a built-in memory, as shown in Table 1 for example, upper limit temperatures (T1*h*, T2*h*, T3*h*, and T4*h*) for the respective detected values (T1, T2, T3, and T4) by the first to fourth temperature detectors 8, 9, 12, and 13, and gains (constants) used to feed back the detected values (T1, T2, T3, and T4) by the first to fourth temperature detectors 8, 9, 12, and 13 for controlling the rotation speed of the fan 15. Two types of gains, that is, first gains (G1, G2, G3, and G4) to be applied when the suction adjustment valve 5 is opened, and second gains (g1, g2, g3, and g4) to be applied when the suction adjustment valves 5 are closed are stored for the respective temperature detectors 8, 9, 12, and 13. The "upper limit temperature" can be referred to as so-called "target value" in the feedback described later. Therefore, in practice, the temperatures of the respective locations can temporarily exceed the "upper limit temperature".

TABLE 1

| TEMPERATURE DETECTOR | 1st | 2nd | 3rd | 4th |
|---|---|---|---|---|
| UPPER LIMIT TEMPERATURE | T1 h | T2 h | T3 h | T4 h |
| 1st GAIN | G1 | G2 | G3 | G4 |
| 2nd GAIN | g1 | g2 | 0 | 0 |

The fan control device 19 checks the detected values (T1, T2, T3, and T4) for the respective first to fourth temperature detectors 8, 9, 12, and 13 every predetermined cycle time, and calculates differences (T1*h*−T1, T2*h*−T2, T3*h*−T3, and T4*h*−T4) between the upper limit temperatures and the detected values, respectively. Then, if the cycle time is considered as a unit and the present time is denoted by n, the fan control device 19 sets a difference having the smallest value in the multiple differences as a representative difference ΔTr(n) at that time point, and sets the gain set to the temperature detector having the smallest difference as a representative gain Gr(n) at that time point. For example, if the second temperature detector 9 has the smallest difference, the representative gain Gr(n) is G2 if the suction adjustment valve 5 is opened at the time n, and is g2 if the suction adjustment valve 5 is closed.

If a set frequency by the inverter 17 at the time n is denoted by X(n), the fan control device 19 sets a value obtained by subtracting a value obtained by multiplying the representative difference ΔTr(n) at the time n by the representative gain Gr(n) from the set frequency X(n) at the time n as a set frequency X(n+1) at a time n+1.

$$X(n+1)=X(n)-Gr(n)*\Delta Tr(n)$$

In this way, only the temperature of a temperature detector closest to the upper limit temperature in the first to fourth temperature detectors 8, 9, 12, and 13, namely the temperature having the least margin is used as a control input for negative feedback, and thereby the rotation speed of the fan 15 is proportionally controlled, according to this embodiment. As a result, in a state where any one of the detected values by the first to fourth temperature detectors 8, 9, 12, and 13 does not exceed the upper limit value with as much effort as possible, the rotation speed of the fan 15 is suppressed to as low as possible and thereby power consumption and noise are reduced.

It should be noted that the reason why the second gains of the third and fourth temperature detectors 12 and 13 are "0" in Table 1 is that, if the suction adjustment valve 5 is closed, a load on the first compressor 1 increases, a temperature of the intermediate channel 6 increases and thus the differences of the third and fourth temperature detectors 12 and 13 (T3*h*−T3 and T4*h*−T 4) will not be smaller than the differences of the first and second temperature detectors 8 and 9 (T1*h*−T1 and T2*h*−T2), so that it is not necessary to set constants for the feedback.

Moreover, the fan control device 19 may receive the representative difference ΔTr(n) as a control input and carry out the PID control on the rotation speed of the fan 15. In this case, each of the first gain and the second gain contains three constants, that is, a proportional constant, an integral constant, and a differential constant, as shown in Table 2. For example, for the first gain for the first temperature detector 8, the proportional constant is G1, the integral constant is G1i, and the differential constant is G1d.

TABLE 2

| TEMPERATURE DETECTOR | 1st | 2nd | 3rd | 4th |
|---|---|---|---|---|
| UPPER LIMIT TEMPERATURE | T1 h | T2 h | T3 h | T4 h |
| 1st GAIN | G1, G1i, G1d | G2, G2i, G2d | G3, G3i, G3d | G4, G4i, G4d |
| 2nd GAIN | g1, g1i, g1d | g2, g2i, g2d | 0, 0, 0 | 0, 0, 0 |

Although according to this embodiment, temperatures of the air in the intermediate channel 6 and the discharge channel 10 are detected as control inputs, temperatures of the first compressor 1, the second compressor 2, the intercooler 7, the aftercooler 11, the motor, and the like, or portions tending to generate heat in the device may be detected as control inputs. For example, an oil temperature and the like in an oil cooling device for an oil cooled compressor may be detected as a control input.

Although according to this embodiment, the opening/closing control is provided for the suction adjustment valve 5, and the first gain and the second gain are selectively used according to the opening/closing of the suction valve 5, the same gain may be used regardless of opening/closing of the suction adjustment valve 5. In other words, one gain (or one set of gains) is used for each of the temperature detectors. Alternatively, one gain (or one set of gains) may be used for each of the temperature detectors for a device configuration without the suction adjustment valve 5.

Although according to this embodiment, the valve which is switched between two states, that is, the open state and the closed state is used as the suction adjustment valve 5, a valve which is capable of continuously varying its opening degree may be used as the suction adjustment valve 5. In this case, a gain (first gain) used when the suction adjustment valve 5 is fully opened and a gain (second gain) used when the suction adjustment valve 5 is fully closed may be stored, and for an intermediate opening degree therebetween, a gain obtained by interpolating between the first gain and the second gain according to the opening degree may be used.

Although the difference and the gain only for the temperature detector having the smallest difference from the upper limit are used in calculation for the fan control according to this embodiment, the difference and the gain of the temperature detector having the second smallest difference from the upper limit and the subsequent temperature detectors in an ascending order of the difference from the upper limit may properly be added to the calculation, in addition to that of the temperature detector having the smallest difference from the upper limit.

The present invention can widely be applied to a compression apparatus for producing a compressed air as well as a compression apparatus for compressing a gas other than air.

What is claimed is:

1. A compression apparatus comprising:

a compressor for compressing a fluid flowing through a flow path; and discharging compressed fluid through the same flow path a plurality of temperature detectors that are provided at different locations along the flow path;

a cooling fan that is capable of changing a rotation speed thereof; and a fan controller that determines the rotation speed of the cooling fan based on detected values by the plurality of temperature detectors;

wherein the fan controller:

sets, in advance, an upper limit temperature and a control gain to each of the plurality of temperature detectors;

calculates a difference between the detected value and the upper limit temperature for each of the plurality of temperature detectors; and determines the rotation speed of the fan based on the smallest value in the differences and the control gain set to the temperature detector having the smallest difference.

2. The compression apparatus according to claim 1, comprising:

a suction adjustment valve that is provided in an intake channel of the flow path for supplying the compressor with a gas;

a pressure detector that detects a discharge pressure of a compressed gas; and a valve controller that opens/closes the suction adjustment valve according to the detected value by the pressure detector, wherein the control gain includes a first gain applied in a case in which the suction adjustment valve is opened, and a second gain applied in a case in which the suction adjustment valve is closed.

3. The compression apparatus according to claim 1, wherein each of the control gains includes a plurality of constants.

4. The compression apparatus according to claim 1, comprising a plurality of the compressor, wherein:

the compressors are serially connected with each other along the flow path; and at least one of the temperature detectors is disposed in a channel of the flow path between the compressors.

5. The compression apparatus according to claim 4, wherein:

an intercooler is provided in the channel of the flow path between the compressors;

at least one of the temperature detectors is provided in the flow path on an upstream side of the intercooler; and at least another one of the temperature detectors is provided in the flow path on a downstream side of the intercooler.

6. The compression apparatus according to claim 1, wherein:

an aftercooler is provided in the flow path on a discharge side of the compressor;

at least one of the temperature detectors is provided in the flow path on an upstream side of the aftercooler; and at least one of the temperature detectors is provided in the flow path on a downstream side of the aftercooler.

* * * * *